US012232630B2

(12) United States Patent
Chen

(10) Patent No.: US 12,232,630 B2
(45) Date of Patent: Feb. 25, 2025

(54) RETRACTABLE AND ADJUSTABLE SOFA ARMREST ASSEMBLY

(71) Applicant: ANJI QIANYUAN FURNITURE CO., LTD., Huzhou (CN)

(72) Inventor: Feng Chen, Hangzhou (CN)

(73) Assignee: ANJI QIANYUAN FURNITURE CO., LTD., Huzhou (CN)

( * ) Notice: Subject to any disclaimer, the term of this patent is extended or adjusted under 35 U.S.C. 154(b) by 0 days.

(21) Appl. No.: 18/243,425

(22) Filed: Sep. 7, 2023

(65) Prior Publication Data

US 2024/0081540 A1 Mar. 14, 2024

(30) Foreign Application Priority Data

Sep. 8, 2022 (CN) ..... 202222393288.6
Nov. 29, 2022 (CN) ..... 202223199697.9

(51) Int. Cl.
*A47C 7/54* (2006.01)
*A47C 17/04* (2006.01)

(52) U.S. Cl.
CPC ..... *A47C 7/541* (2018.08); *A47C 17/04* (2013.01)

(58) Field of Classification Search
CPC ..... A47C 7/541; A47C 17/04
USPC ..... 297/411.3, 411.37, 411.45
See application file for complete search history.

(56) References Cited

U.S. PATENT DOCUMENTS 8,573,686 B2 * 11/2013 Bruck ..... B60N 2/829 297/61
8,662,595 B2 * 3/2014 Kramer ..... A47C 7/748 297/423.34
10,589,649 B1 * 3/2020 Oleson ..... B60N 2/02
11,406,192 B1 * 8/2022 Wu ..... A47C 7/42
11,707,138 B1 * 7/2023 Wu ..... A47C 7/546 5/12.1
2011/0175422 A1 * 7/2011 Bruck ..... B60N 2/829 297/410
2020/0079262 A1 * 3/2020 Oleson ..... B60N 2/829
2020/0281362 A1 * 9/2020 Morgavi ..... A47C 7/40

FOREIGN PATENT DOCUMENTS

CN 108523512 A 9/2018
CN 209031606 U 6/2019
CN 210103252 U 2/2020
CN 114916789 A 8/2022

OTHER PUBLICATIONS

U.S. Appl. No. 18/798,066; Title: "Armrest Mechanism of Foldable Sofa"; Applicant: Anji Qianyuan Furniture Co., Ltd.; filed Aug. 8, 2024.*

* cited by examiner

*Primary Examiner* — Rodney B White
(74) *Attorney, Agent, or Firm* — Jiwen Chen; Joywin IP Law PLLC

(57) ABSTRACT

An extendable and retractable sofa armrest assembly includes, a fixed inner panel for sofa attachment, a movable outer panel parallel and spaced on the sides, and an extendable and retractable assembly between them. The extendable and retractable assembly includes interconnected rotational rods, allowing the movable outer panel to switch between folded and open positions. An armrest cover wraps both panels, creating a flexible support portion. In use, the outer panel is open, tensioning the support. In a packed state, the outer panel draws close to the fixed panel, compressing the assembly.

16 Claims, 11 Drawing Sheets

RETRACTABLE AND ADJUSTABLE SOFA ARMREST ASSEMBLY

This application claims priority of Chinese Application No. 202222393288.6, filed Sep. 8, 2022 and Chinese Application No. 202223199697.9, filed Nov. 29, 2022, all of which are hereby incorporated by reference.

TECHNICAL FIELD

The present invention relates to the field of seats, in particular to a sofa armrest assembly that is extendable and retractable by adjustment.

BACKGROUND TECHNOLOGY

A sofa is a multi-seat chair with upholstery. As a back chair with springs or thick foam plastics, etc., with armrests on both sides, it is a type of upholstered furniture. The general structure of the traditional sofa is relatively fixed and cannot be adjusted, and the sofa body is generally made of metal or wood; such a sofa is very heavy. At present, in order to adapt to the development trend of e-commerce and reduce the cost of product packaging and transportation; most manufacturers have modularized the sofa, so that the components such as the seat, back and armrest of the sofa can be disassembled and stacked or assembled together, thereby reducing the overall size and packaging volume of the sofa, thus increasing the loading capacity for transportation.

However, the volume of the components such as the seat, the back and the armrest in the above-mentioned modular sofa cannot be changed, and the packing volume can only be saved by stacking each component reasonably. Thus, the saving in space is undoubtedly is limited.

SUMMARY OF THE INVENTION

The object of the present invention is to overcome the shortcomings in the above-mentioned prior art and provide an extendable and retractable sofa armrest assembly, wherein an extendable and retractable assembly is provided between a fixed inner panel and a movable outer panel; a three-dimensional shaped armrest assembly is provided between the fixed inner panel and the movable outer panel and covering an armrest cover; then the movable outer panel can be folded or opened relative to the fixed inner panel through the extendable and retractable assembly, so that the thickness of the armrest assembly in the left and right directions can be adjusted accordingly.

The technical solution of the present invention is as follows:

An extendable and retractable sofa armrest assembly, the armrest assembly comprises: a fixed inner panel configured to be connected to a side of the sofa main body; a movable outer panel parallel to the fixed inner panel and spaced left and right; an extendable and retractable assembly connected to and between the fixed inner panel and the movable outer panel; the extendable and retractable assembly comprises two cross-hinged rotating rods, and the two rotating rods can rotate with each other so that the movable outer panel has a folded or closed state or position close to the fixed inner panel and an open state or position away from the fixed inner panel. The armrest cover covers or wrapped over both the inner panel and the outer panel at the same time; and the part of the armrest cover located between the inner panel and the outer panel forms a flexible support part of the armrest. During use, the movable outer panel is in the open state, the flexible supporting part of the armrest is correspondingly tensioned. In the closed state, the movable outer panel and the fixed inner panel are folded together to compress the thickness of the armrest assembly, and the flexible supporting part of the armrest is correspondingly relaxed.

Preferably, at least two sets of extendable and retractable assemblies are arranged between the fixed inner panel and the movable outer panel. In addition to being used to move the outer panel, the extendable and retractable component also plays a connection role; thus, the connection between the movable outer panel and the fixed inner panel is stable and strong.

Preferably, the armrest cover is a cloth cover or a leather cover. It is malleable so that it can be tensioned or relaxed accordingly.

Preferably, the extendable and retractable assembly is a left-right symmetrical structure, and the extendable and retractable assembly also includes two connecting plates spaced apart at left and right and respectively connected to the outer side wall of the fixed inner panel and the inner side wall of the movable outer panel. The two rotating rods are arranged between the two connecting plates along the left and right directions. The respective centers of the two rotating rods are hinged together; and one end of any rotating rod is hinged to one of the connecting plates, and the other end of the rotating rod is longitudinally connected to the other connecting plate in a slip fit or sliding manner. Then it is only necessary to directly assemble the extendable and retractable assembly between the fixed inner panel and the movable outer panel.

As a preference, each connecting plate is provided with an upper support and a lower support separated from each other; the upper support is provided with a longitudinal guide groove, and the upper end of each rotating rod is correspondingly provided with a guide pin in guide groove. The upper end of the rotating rod can slide up and down along the guide groove, so that the two connecting plates can be folded and opened.

As a preference, a limit notch capable of engaging with the guide pin is provided at the bottom end of the guide groove; in the state of use, the guide pin moves down along the guide groove to engage with the limit notch. Thereby, the position of the guide pin can be limited, and the movable outer panel can be prevented from easily moving inwardly in the state of use.

Preferably, the armrest cover also has an inner connection part that is attached to the fixed inner panel and an outer connection part that is attached to the movable outer panel, respectively located on both sides of the flexible support part of the armrest. The left and right sides of the armrest cover are respectively attached to the fixed inner panel and the movable outer panel, and the structure is aesthetically pleasing. The flexible support part of the armrest can also better respond to the movement of the movable outer panel and correspondingly tension or collapse.

Preferably, a control handle is provided on the outside of the armrest assembly, and the control handle is sewn on the armrest cover at the corresponding position. It makes the adjustment operation easier and labor-saving.

Preferably, in the state of use, the armrest cover, the movable outer panel and the fixed inner panel form a three-dimensional rectangular structure.

Preferably, in the state of use, an armrest cushion is placed on the upper end of the flexible support part of the armrest, and the armrest cushion straddles the fixed inner panel and the movable outer panel along the left and right direction. Then the user can place the arm on the armrest cushion, which is comfortable to use; and the fixed inner panel and the movable outer panel can effectively support the armrest cushion.

An extendable and retractable sofa armrest assembly, comprising:

a fixed inner panel configured to attach to the sides of the sofa body;

a movable outer panel being parallel to and space apart from the fixed inner panel left and right;

an extendable and retractable assembly being connected between the fixed inner panel and the movable outer panel; the extendable and retractable assembly comprises two cross-hinged rotating rods, and the two rotating rods can rotate with each other so that the movable outer panel has a folded or closed state or position close to the fixed inner panel and an open state or position away from the fixed inner panel. The inner wall of the fixed inner panel and the inner wall of the movable outer panel are respectively provided with an upper support and a lower support that are separated in the up and down direction. The upper support is provided with a longitudinal guide groove. The end of the rotating rod is provided with a guide pin that is slidingly matched with the guide groove; one end of any rotating rod is slidingly matched with the upper support, and the other end of the rotating rod is hinged on the lower support obliquely opposite to the upper support. A horizontal limit notch is provided at the end of the guide groove of one of the upper supports;

an auxiliary spring being arranged between the fixed inner panel and the movable outer panel, and when the movable outer panel is relatively far away from the fixed inner panel, the auxiliary spring deforms to generate elastic force;

an armrest cover being coated on the fixed inner panel and the movable outer panel at the same time; and the part of the armrest cover located between the fixed inner panel and the movable outer panel forms the flexible support part of the armrest;

In the use state, the movable outer panel is in the open state, and the flexible support part of the armrest is correspondingly tensioned; the movable outer panel moves from the folded position relative to the fixed inner panel to the open position so that the guide pin slides to the end of the guide groove; the auxiliary spring correspondingly stretching and deforming and providing the pulling force for the horizontal recovery of the movable outer plate, so that the guide pin can move horizontally and snap into the limit notch.

Preferably, the guide grooves are longitudinally inclined; and from top to bottom, any one of the guide grooves extends and inclines toward the center of the rotating rod. This makes the guide pin move more smoothly; and the auxiliary elastic force will make the guide pin be locked into the limiting notch horizontally preferentially.

Preferably, the auxiliary spring is arranged obliquely between the fixed inner panel and the movable outer panel.

Preferably, the auxiliary spring is arranged horizontally between the fixed inner panel and the movable outer panel.

As a preference, a hook seat is respectively provided on the upper end of the fixed inner panel and the lower end of the movable outer panel. The hook seat is horizontally separated from the upper support and the lower support; the two ends of the auxiliary spring are respectively connected to the hook seat on; to prevent the auxiliary spring from interfering with the extendable and retractable assembly.

The design starting point, concept and beneficial effects of the present invention that have adopted the above-mentioned technical scheme are:

In the extendable and retractable sofa armrest assembly of the present invention, by connecting the extendable and retractable assembly between the fixed inner panel and the movable outer panel, the movable outer panel has a folded state close to the fixed inner panel, and has a position away from the fixed inner panel. In the open state; and the armrest cover is covered between the movable outer panel and the fixed inner panel, and the movable outer panel, fixed inner panel and extendable and retractable components are all hidden in the armrest cover, making the armrest assembly simple and aesthetically pleasing, no difference from the traditional armrest. And the armrest cover has a flexible support portion of the armrest located between the movable outer panel and the fixed inner panel; when the armrest assembly is in use, the movable outer panel is in an open state, and the flexible support portion is in a tensioned state; At this time, the thickness of the handrail assembly itself is the largest, and it can be used as a support for most conventional handrails. And when the armrest assembly needs to be packaged and transported, it is only necessary to move the movable outer panel towards the fixed inner panel to the folded state through the extendable and retractable assembly, and the flexible support part of the armrest will be in a relaxed state accordingly; at this time, the thickness of the armrest assembly is the smallest. Thereby, the thickness of the armrest can be compressed, and the volume of the armrest assembly itself can be reduced; so that the packaging volume of the components can be reduced to the greatest extent during packaging and transportation.

Further speaking, an auxiliary spring is set between the fixed inner plate and the movable outer plate. The significance of setting the auxiliary spring is that if there is no above-mentioned auxiliary spring, after the movable outer plate is pulled out, it is necessary to clap back with hands to make the guide pin enter the limit notch to limit the position; the above-mentioned auxiliary spring is provided, and after the movable outer plate is pulled out by hand, the action of clapping back to help reset is saved.

Secondly, in the armrest assembly of the present invention, only the fixed inner panels and the movable outer panels on both sides are panel structures; and there are no other panel structures between the fixed inner panels and the movable outer panels, which is different from traditional wooden frame handrails. The front, rear, left, right, top, and bottom are enclosed and fixed by wooden boards; thus, the boards can be saved and the cost can be saved; the overall weight of the handrail assembly is lighter.

Figure 1:
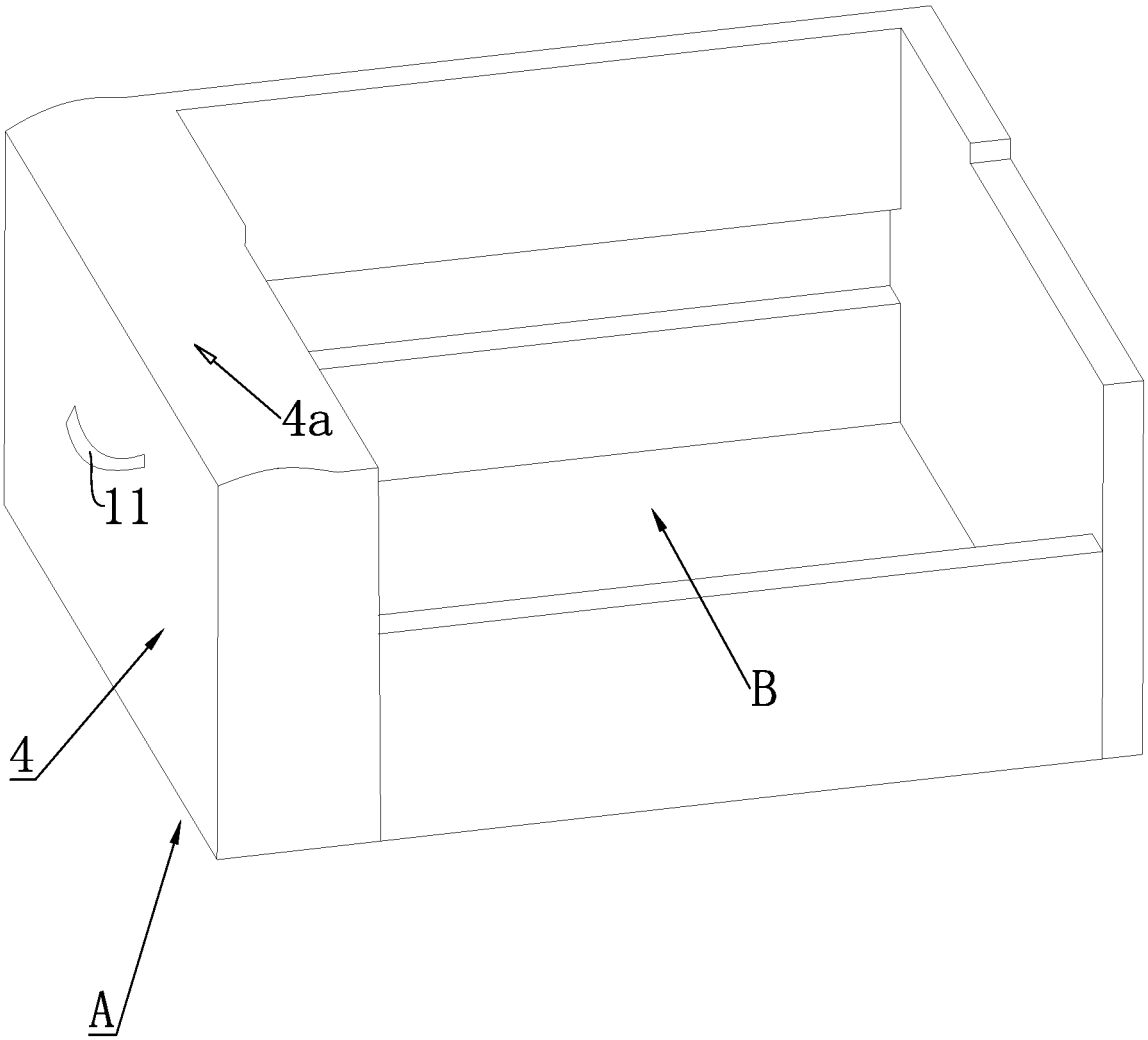
FIG. 1 is the schematic diagram of the three-dimensional structure of the armrest assembly under the state of use in the embodiment of the present invention.

The reference signs are: armrest assembly A; sofa main body B; fixed inner panel 1; movable outer panel 2; extendable and retractable assembly 3; armrest cover 4; armrest flexible support part 4*a*; upper support 7; lower support 8; guide groove 9; guide pin 10; control handle 11; armrest cushion 12; limit notch 13.

DETAILED DESCRIPTION OF THE INVENTION

In order to understand the above-mentioned purpose, features and advantages of the present invention more clearly, the present invention will be further described in detail below in conjunction with the accompanying drawings and specific embodiments. It should be noted that, in the case of no conflict, the embodiments of the present application and the features in the embodiments can be combined with each other.

This embodiment involves reference orientations of various components, such as front and rear, etc., which are described in a normal use state where the user sits behind the sofa.

The specific embodiment of the present invention is as follows:

As shown in FIGS. 1-9, the present invention provides an extendable and retractable sofa armrest assembly. The armrest assembly A includes a fixed inner panel 1 connected to the side of the sofa main body B, parallel to the fixed inner panel 1 and spaced apart movable outer panel 2, extendable and retractable assembly 3 and armrest cover 4; wherein, the extendable and retractable assembly 3 is connected between the fixed inner panel 1 and the movable outer panel 2, and the extendable and retractable assembly 3 is configured so that the movable outer panel 2 has a direction toward the closed state of the fixed inner panel 1, and the open state away from the fixed inner panel 1; the movable outer panel 2, the fixed inner panel 1 and extendable and retractable assembly 3 are all hidden in the armrest cover 4, making the armrest assembly A simple and aesthetically pleasing. And the armrest cover 4 has the armrest flexible support part 4*a* between the movable outer panel 2 and the fixed inner panel 1; when the armrest assembly A is in use, the movable outer panel 2 is in an open state, and the armrest flexibly supports part 4*a* is in a tensioned state; at this time, the thickness of the handrail assembly A is the largest, and it can be used as a support for most conventional handrails. And when the armrest assembly A needs to be packaged and transported, it is only necessary to move the movable outer panel 2 toward the fixed inner panel 1 to the folded state through the extendable and retractable assembly 3, and the flexible support part 4*a* of the armrest will be in a relaxed state accordingly. The thickness of the armrest assembly A is the smallest; thus, it can compress the thickness of the armrest and reduce the volume of the armrest assembly A itself; so that the packaging volume of the components can be reduced to the greatest extent during packaging and transportation.

Figure 2:
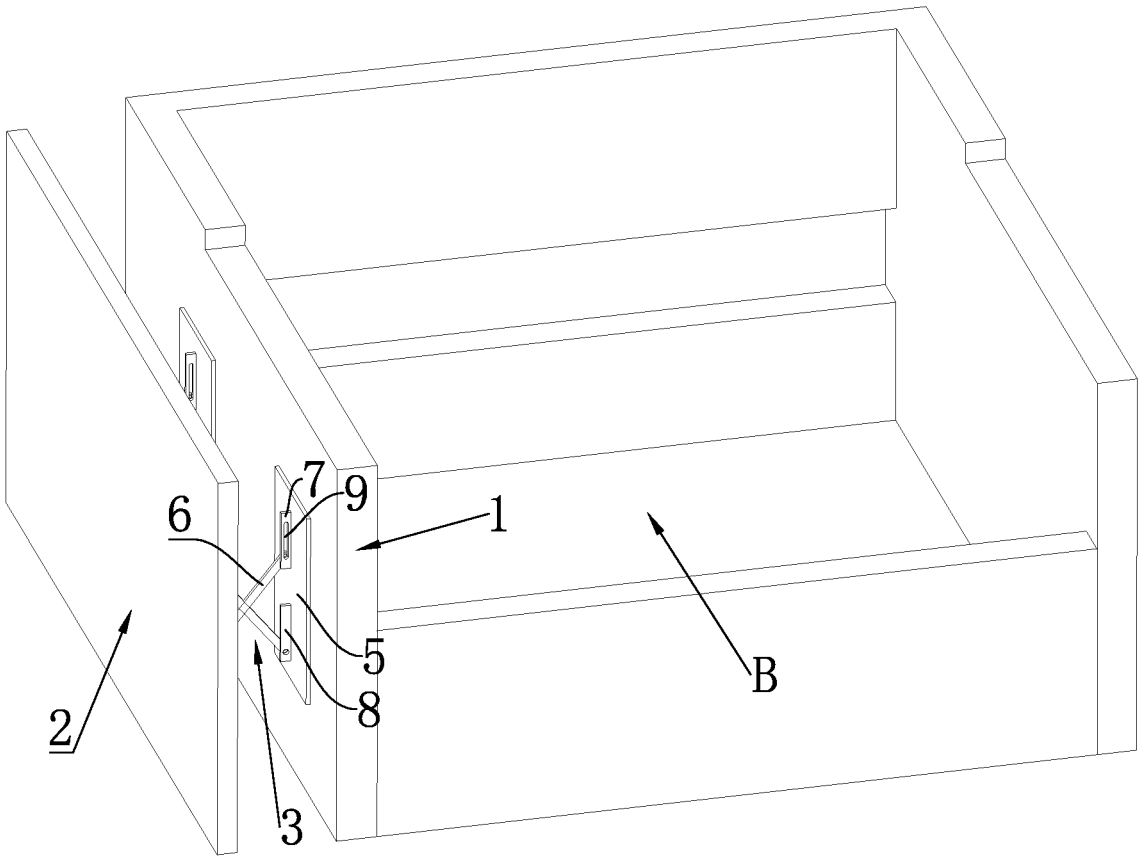
FIG. 2 is a schematic diagram of the three-dimensional structure between the movable outer panel and the fixed inner panel in an open state in an embodiment of the present invention.
Figure 3:
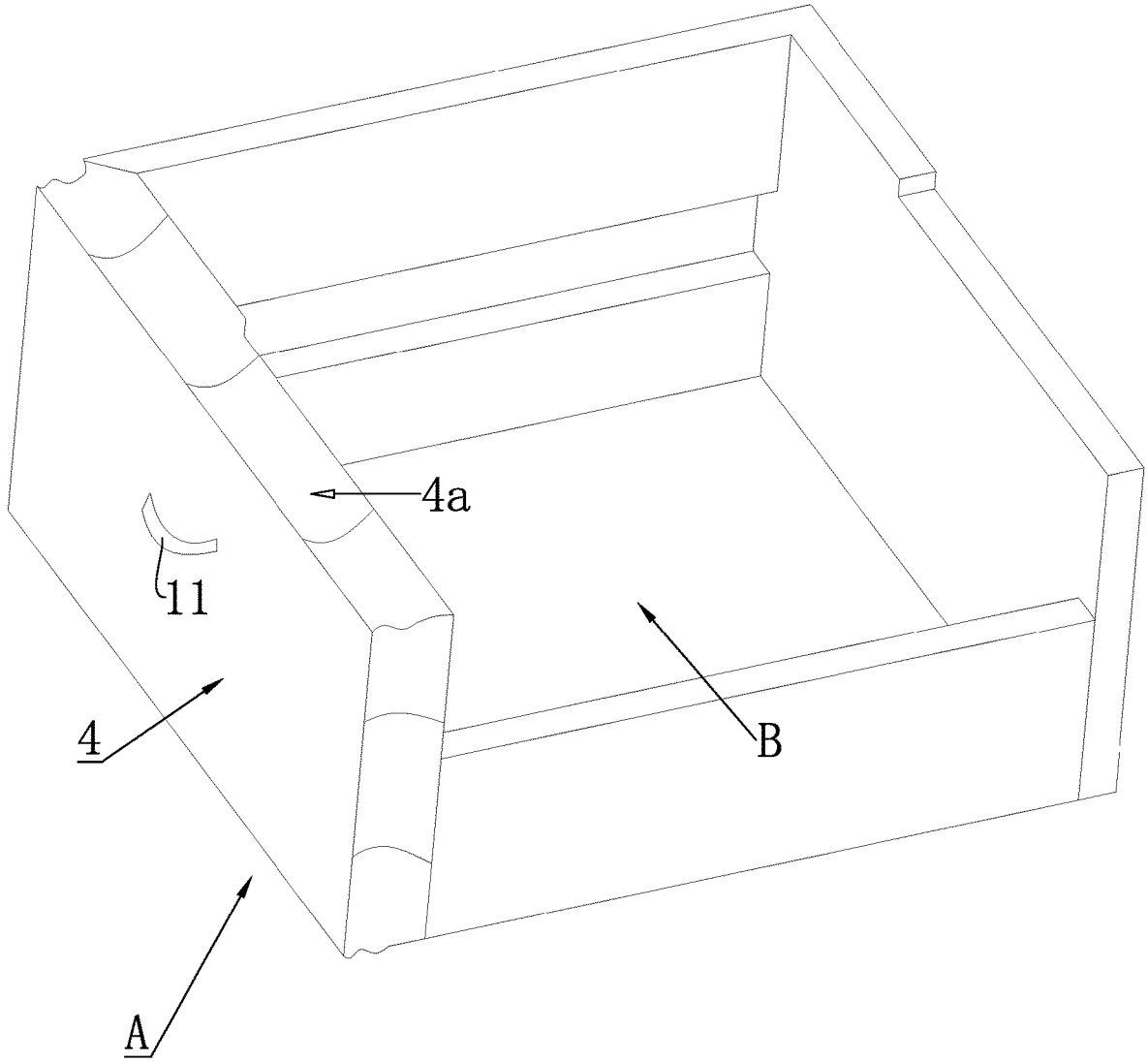
FIG. 3 is a schematic diagram of the three-dimensional structure of the armrest assembly in the packaging state in the embodiment of the present invention.
Figure 4:
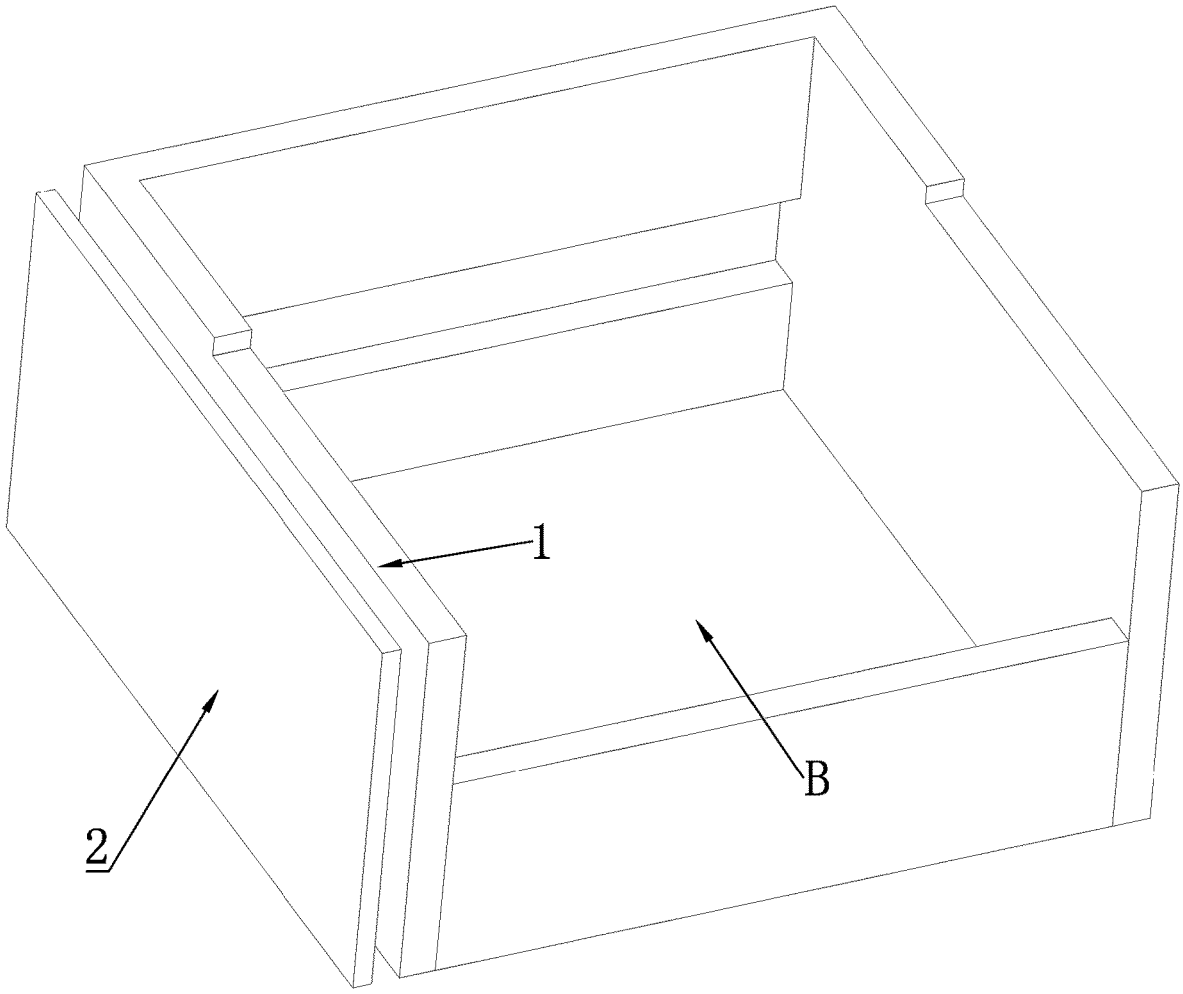
FIG. 4 is a schematic diagram of the three-dimensional structure between the movable outer panel and the fixed inner panel in the folded state in the embodiment of the present invention.
Figure 5:
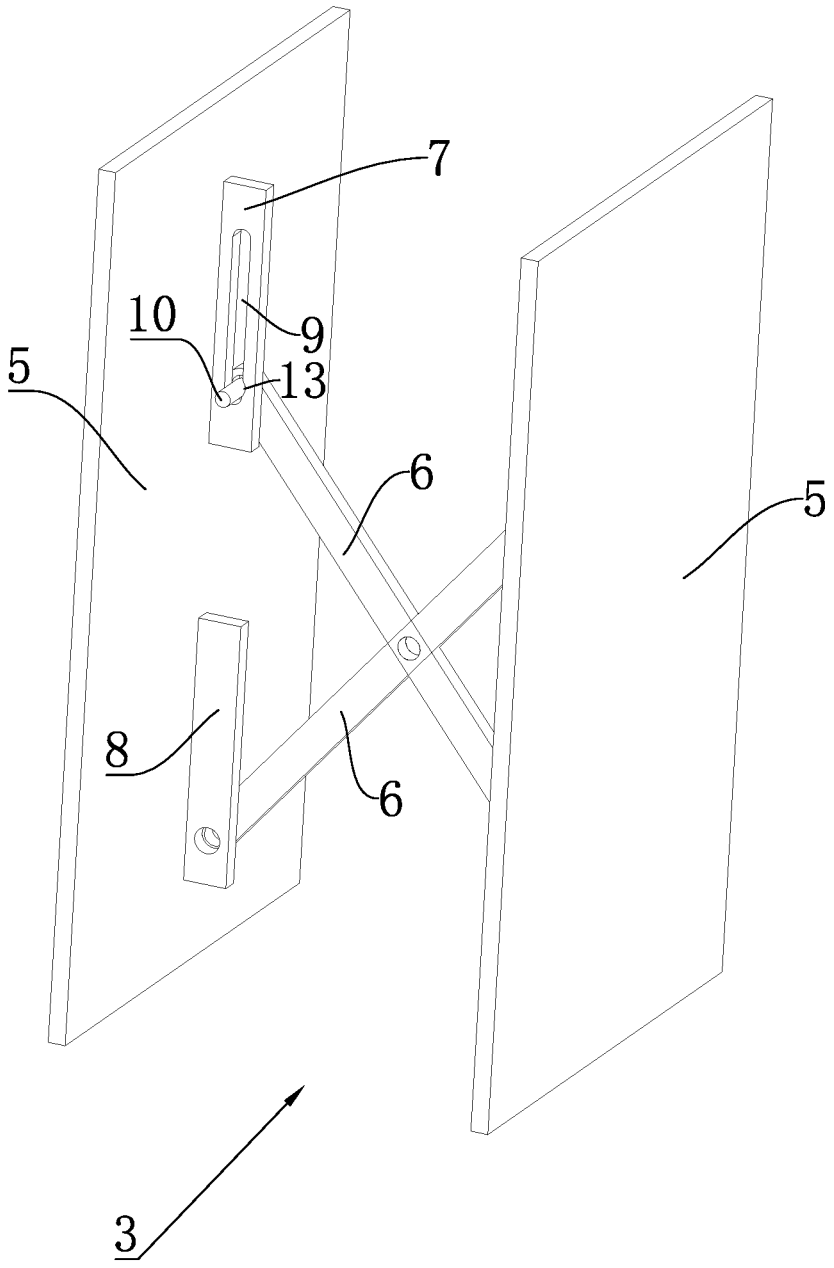
FIG. 5 is a schematic diagram of the three-dimensional structure of the extendable and retractable assembly in the embodiment of the present invention.
Figure 6:
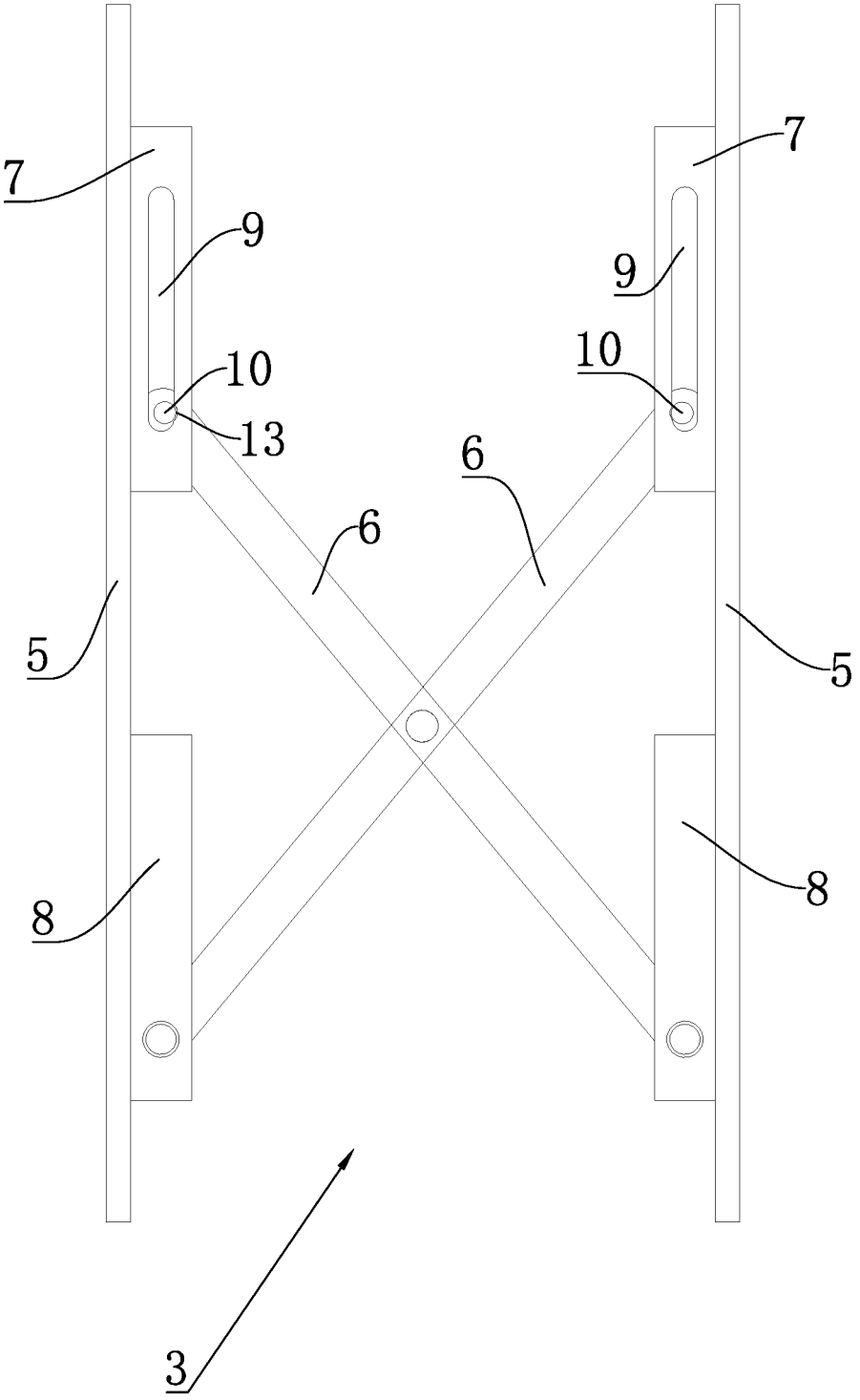
FIG. 6 is the front view when the extendable and retractable assembly is opened in the embodiment of the present invention.
Figure 7:
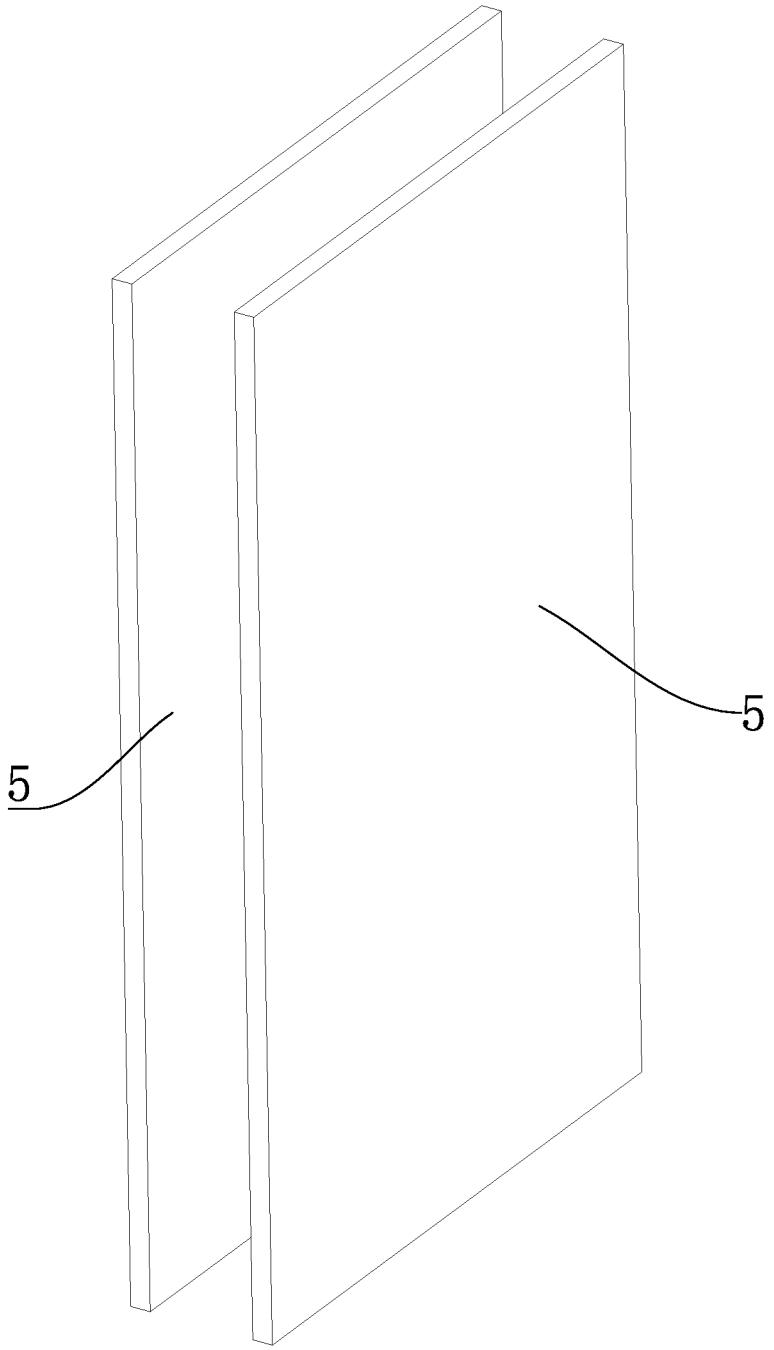
FIG. 7 is a schematic diagram of the three-dimensional structure of the extendable and retractable assembly in the embodiment of the present invention when it is folded.
Figure 8:
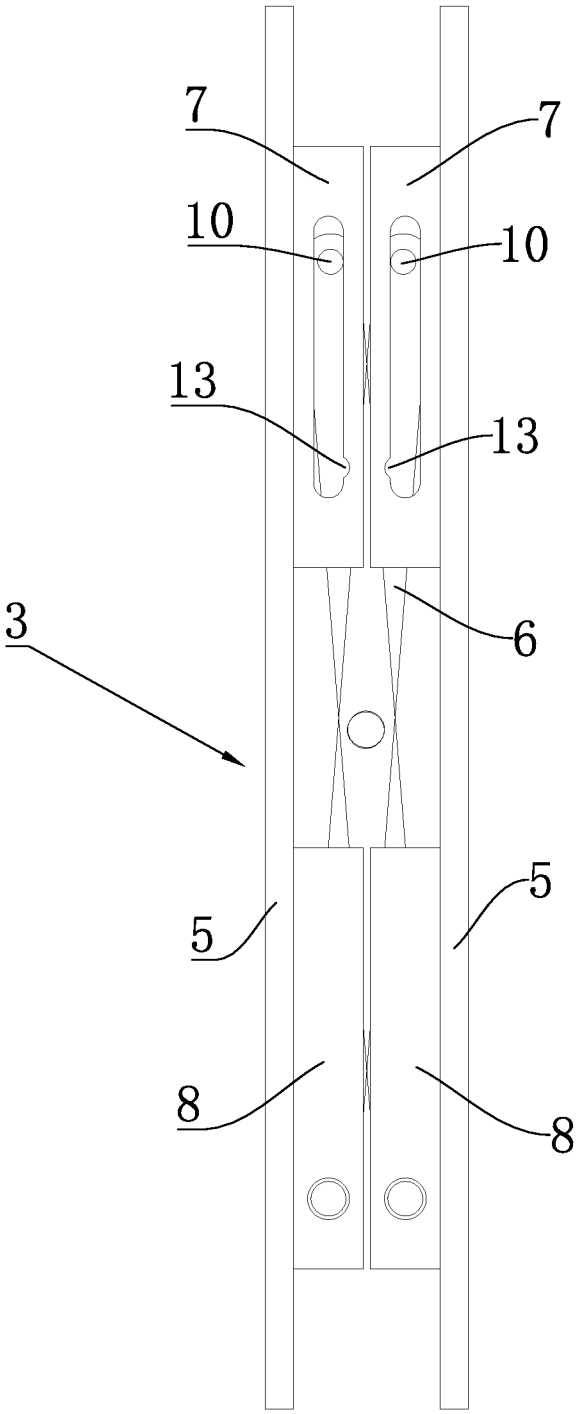
FIG. 8 is a front view of the extendable and retractable assembly in the embodiment of the present invention when it is folded.

As shown in FIGS. 2-8, the extendable and retractable assembly 3 is a left-right symmetrical structure. The extendable and retractable assembly 3 comprises two connecting plates 5 spaced apart from the left and right, and the rotating rod 6 joined together by two cross-hinged joints and arranged between the two connecting plates 5. More specifically, each connecting plate 5 is provided with upper and lower upper supports 7 and lower supports 8. As shown in FIGS. 5 and 6, the upper support 7 of the each connecting plate 5 is provided with a longitudinal guide groove 9, and the upper end of each rotating rod 6 is correspondingly provided with a guide pin 10 that can be installed through and slidably fitted in the guide groove 9. The respective centers of the two rotating rods 6 are hinged together. The upper end of any rotating rod 6 slides within the guide groove 9 on one of the connecting plates 5, while the lower end of the rotating rod 6 is hinged on the lower support 8 of the other connecting plate 5. Thus, as shown in FIG. 5-8, by controlling the mutual rotation between the two rotating rods 6, the upper end of any rotating rod 6 can slide up and down along the guide groove 9, so that the two connecting plates 5 can be folded and opened; and as shown in FIG. 6, the bottom end of the guide groove 9 is also provided with a limit notch 13 that can be engaged with the guide pin 10. In use state, the guide pin 10 moves down along the guide groove 9 to engage with the limiting notch 13. Thereby, it is possible to limit the position of the guide pin 10, so as to prevent the movable outer panel 2 from easily moving inward in the state of use, and play a role of preventing retreat; and when the state of use is changed to the packing state, the movable outer panel 2 can be struck inward with force. When the guide pin 10 is disengaged from the limit notch 13, the guide pin 10 can be reversely reset along the guide groove 9. As shown in FIG. 2, when the extendable and retractable assembly 3 is specifically applied in the armrest assembly A, one of the connecting plates 5 is connected to the outer wall of the fixed inner panel 1, and the other connecting plate 5 is connected and fixed to the outer wall of the movable outer panel 2. On the inner side wall; so that the movable outer side panel 2 can be closed or opened outward relative to the fixed inner side panel 1; and it only needs to act directly on the movable outer side panel 2, and the adjustment operation is very convenient. Furthermore, at least two sets of extendable and retractable assemblies 3 are provided between the movable outer panel 2 and the fixed inner panel 1, and the extendable and retractable assemblies 3 also serve to connect the movable outer panel 2 and the fixed inner panel 1, thereby making the structural connection more stable.

Furthermore, as shown in FIGS. 1-4; after the movable outer panel 2 and the fixed inner panel 1 are assembled, the armrest cover 4 covers between the outside of the two, and the armrest cover 4 is a holster; thereby making the movable outer panel 2, the fixed inner panel 1 and the armrest coat 4 form a three-dimensional armrest assembly A. The movable outer panel 2, the fixed inner panel 1 and the extendable and retractable assembly 3 are all covered inside the armrest cover 4. The armrest assembly A has no difference in appearance from conventional armrests, and the structure is simple and aesthetically pleasing. In addition, the armrest cover 4 also has an inner connecting portion attached to the fixed inner panel 1 and an outer connecting portion attached to the movable outer panel 2 respectively located on both sides of the armrest flexible support portion 4*a*. The parts on the left and right sides of the armrest cover 4 are respectively attached to the fixed inner panel 1 and the movable outer panel 2, and the structure is aesthetically pleasing; the flexible support part 4*a* of the armrest can also better respond to the movement of the movable outer panel 2 and correspondingly tension or collapse. Moreover, a control handle 11 is also provided on the outer side wall of the armrest assembly A, and the control handle 11 is sewn on the armrest cover 4 at the corresponding position; then the user can easily control the movable outer panel 2 by pulling the control handle 11, making the adjustment operation easier and less labor-intensive.

Figure 9:
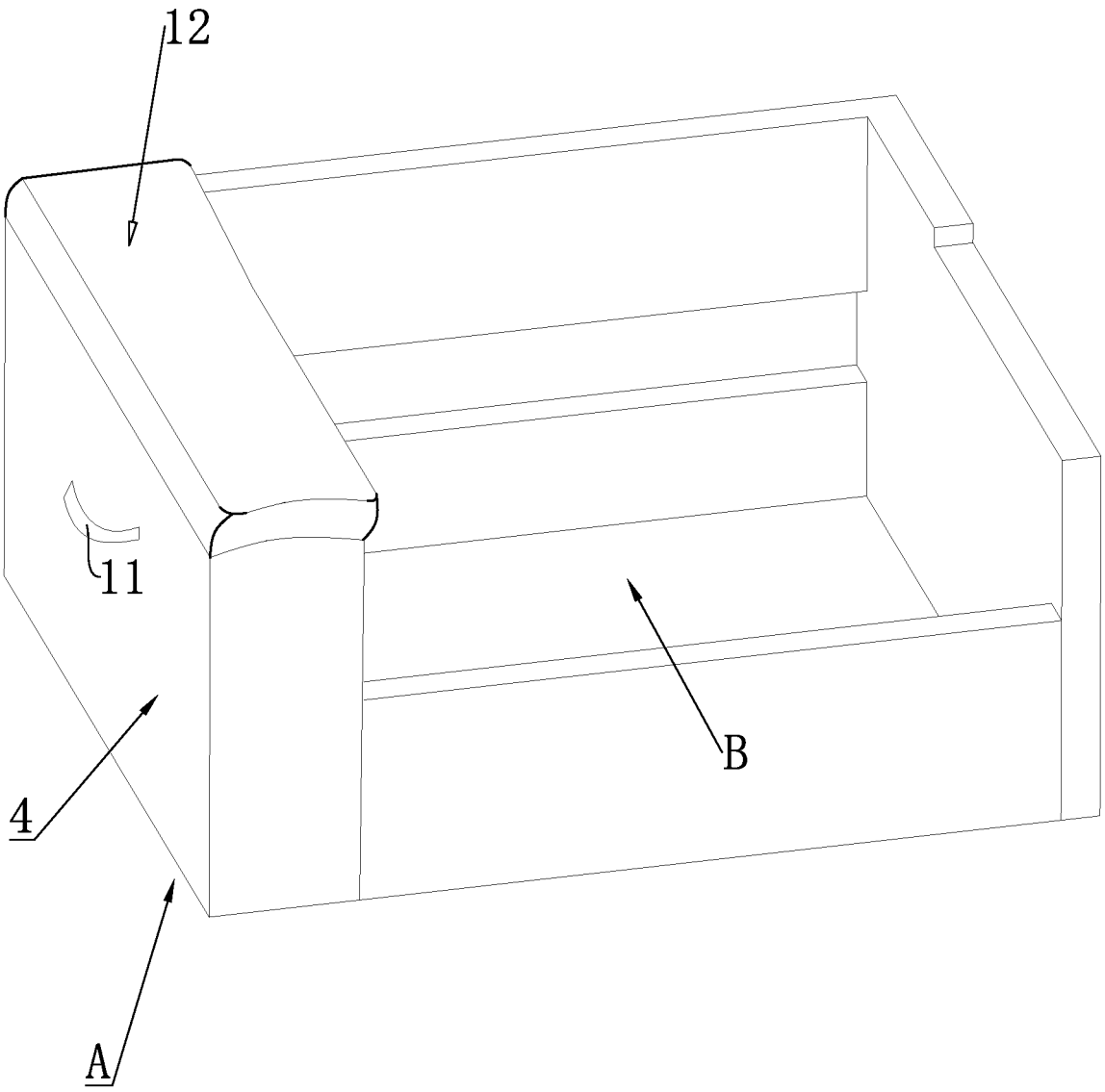
FIG. 9 is a three-dimensional schematic diagram of the present invention when the armrest cushion is set on the armrest assembly in the use state of the embodiment.

In addition, as shown in FIG. 9, when the armrest assembly A is in use, an armrest cushion 12 is further placed on the upper end of the flexible armrest support part 4*a*, and the armrest cushion 12 straddles the fixed inner side plate 1 and the movable outer panel 2 along the left and right direction. Then, in the use state, the user can place the arm on the armrest cushion 12, which is comfortable to use; and the fixed inner panel 1 and the movable outer panel 2 can effectively support the armrest cushion 12 to ensure the support strength.

Figure 10:
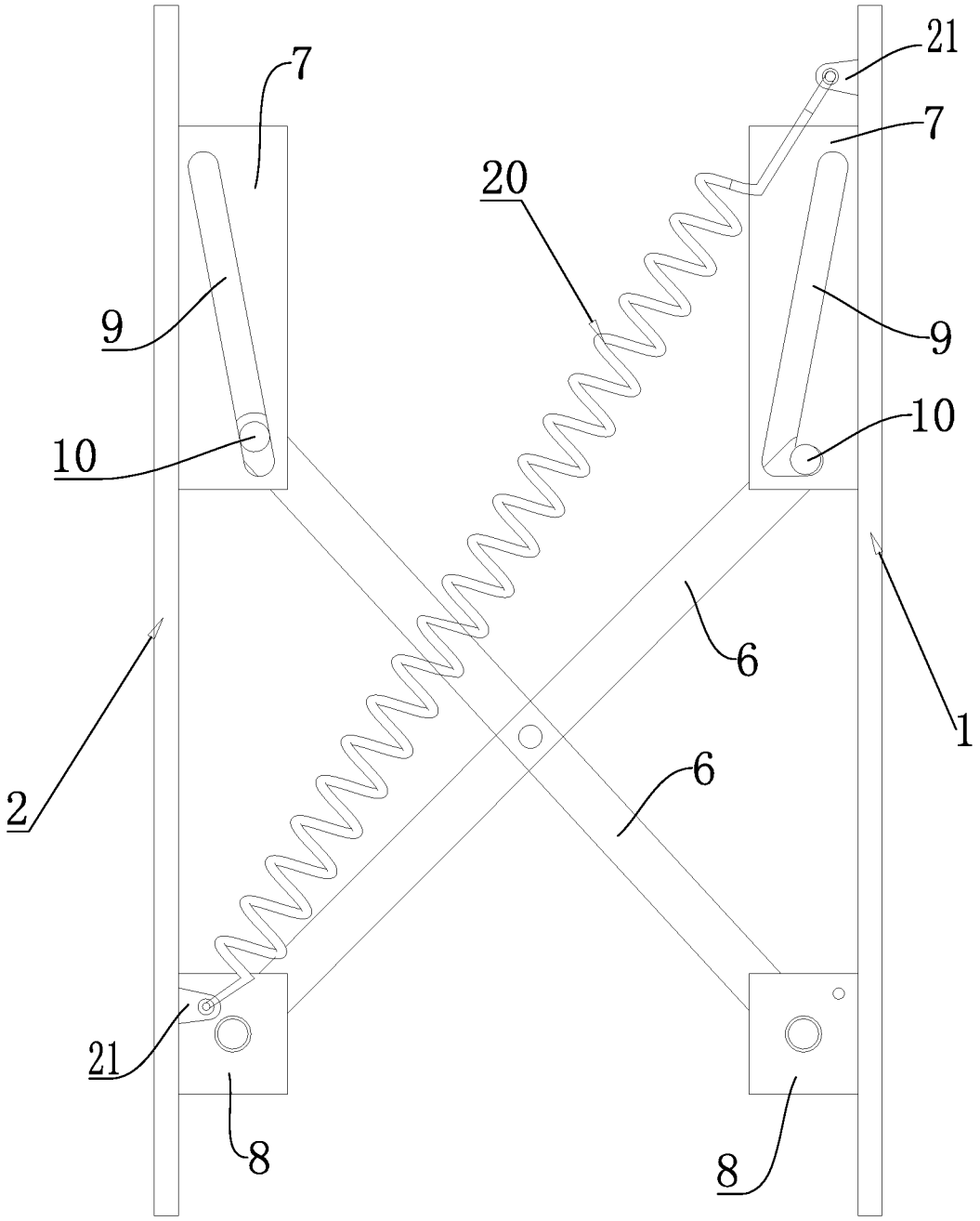
FIG. 10 is a schematic diagram of the auxiliary spring hanging between the fixed inner plate and the movable outer plate in the embodiment, and making the guide pin snap into the limit notch.

Furthermore, as shown in FIG. 10, an auxiliary spring 20 is provided between the fixed inner panel 1 and the movable outer panel 2, and when the movable outer panel 2 is relatively far away from the fixed inner panel 1, the auxiliary spring 20 deforms to generate elastic force. More specifically, the auxiliary spring 20 is obliquely arranged between the fixed inner panel 1 and the movable outer panel 2, and the upper end of the fixed inner panel 1 and the lower end of the movable outer panel 2 are respectively provided with a hook seat 21. The hook seat 21 is horizontally separated from the upper support 7 and the lower support 8. The two ends of the auxiliary spring 20 are respectively connected on the hook seat 21; the auxiliary spring 20 is obliquely arranged like this, and when the movable outer panel 2 is away from the fixed inner panel 1, the auxiliary The deformation of the spring 20 generates a component force in the horizontal direction, so that the movable outer panel 2 retreats, and the guide pin 10 is automatically snapped into the limiting notch 13.

Figure 11:
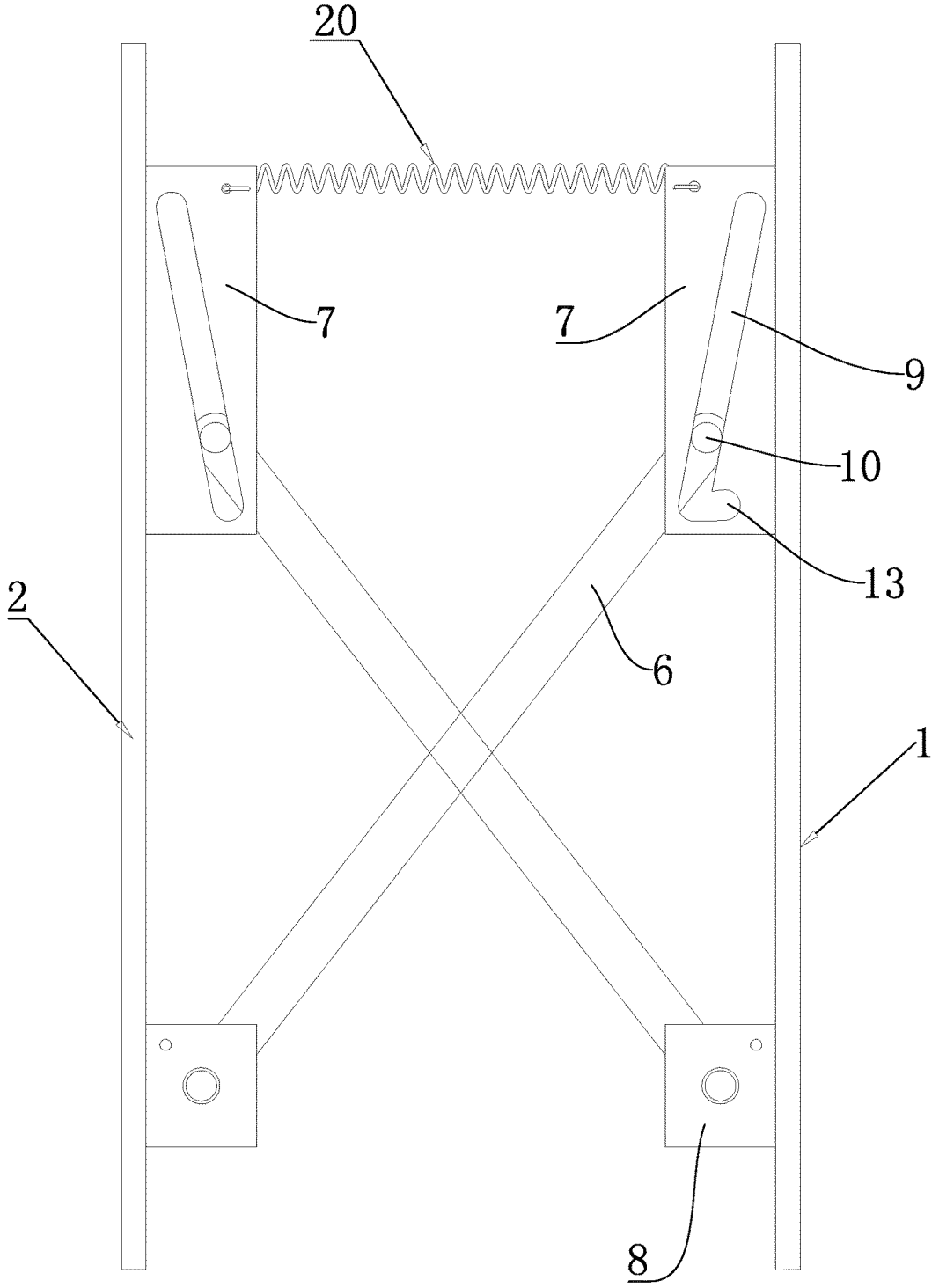
FIG. 11 is a schematic diagram of the auxiliary spring in the embodiment using the horizontal hanging method.

Still another embodiment, as shown in FIG. 11, the auxiliary spring 20 is horizontally arranged between the fixed inner panel 1 and the movable outer panel 2, which can also achieve the similar effects as above.

Then, when the manufacturer packs and transports the seat, the armrest is kept in a folded state, so that the thickness of the armrest can be reduced, and the packaging volume can be reduced. After the user receives the seat, the armrest can be automatically limited to the open state by directly pulling the movable outer panel; and the user does not consider retracting the armrest after opening it, and keeps it in the open state to use the seat after pulling it out.

The invention claimed is:

1. An extendable and retractable sofa armrest assembly, comprising:

a fixed inner panel configured for attachment to a side of a sofa body;

a movable outer panel parallel to and spaced apart from the fixed inner panel in a left and right arrangement;

an extendable and retractable assembly provided between the fixed inner panel and the movable outer panel, the extendable and retractable assembly comprising two rotational rods that are hinged together crosswise and capable of rotating relative to each other, thereby enabling the movable outer panel to transition between a folded position towards the fixed inner panel and an open position moving away from the fixed inner panel;

an armrest cover enveloping both the inner panel and the outer panel, the armrest cover forming a flexible support portion for the armrest between the inner panel and outer panel;

wherein in an in-use state, the movable outer panel is in an open position, and the armrest's flexible support portion is correspondingly tensioned; in a packed state, the movable outer panel is brought closer to the fixed inner panel to compress the thickness of the armrest assembly, and the armrest's flexible support portion is correspondingly relaxed.

2. The extendable and retractable sofa armrest assembly according to claim 1, wherein, at least two sets of extendable and retractable assemblies are provided between the fixed inner panel and the movable outer panel.

3. The extendable and retractable sofa armrest assembly according to claim 1, wherein the armrest cover is made of fabric or leather.

4. The extendable and retractable sofa armrest assembly according to claim 1, wherein, the extendable and retractable assembly is a symmetrical structure and comprises two connecting plates positioned symmetrically on left and right sides, each connected to an outer side wall of the fixed inner panel and an inner side wall of the movable outer panel, respectively; two rotational rods are oriented along the left and right directions, situated between the two connecting plates; centers of the two rotational rods are hinged together; a first end of each rotational rod is hinged to one of the connecting plates, while a second end of each rotational rod is longitudinally slidably engaged with the other connecting plate.

5. The extendable and retractable sofa armrest assembly according to claim 4, wherein, each connecting plate is equipped with upper supports and lower supports that are spaced apart in an upper-lower arrangement; the upper supports comprise longitudinal guide slots, and each upper end of the rotational rods is provided with a guide pin capable of slidingly engaging within the guide slots.

6. The extendable and retractable sofa armrest assembly according to claim 5, wherein, at a bottom end of the guide slots, there are limit notches capable of engaging with the guide pins; in the in-use state, the guide pins slide downward along the guide slots until the guide pins engage with the limit notches.

7. The extendable and retractable sofa armrest assembly according to claim 1, wherein, the armrest cover further comprises:

inner connecting portions adhered to and connected with the fixed inner panel, positioned on each side of the armrest's flexible support portion, and outer connecting portions adhered to and connected with the movable outer panel.

8. The extendable and retractable sofa armrest assembly according to claim 7, wherein, an operational handle is positioned on an exterior of the armrest assembly, which is stitched onto the armrest cover at a corresponding location.

9. The extendable and retractable sofa armrest assembly according to claim 1, wherein, in the in-use state, the armrest cover, movable outer panel, and fixed inner panel together form a three-dimensional rectangular structure.

10. The extendable and retractable sofa armrest assembly according to claim 1, wherein, in the in-use state, an armrest cushion is positioned at the upper end of the armrest's flexible support portion, spanning across the fixed inner panel and movable outer panel in the left and right directions.

11. An extendable and retractable sofa armrest assembly, comprising:

a fixed inner panel configured for attachment to a side of a sofa body;

a movable outer panel parallel to and spaced apart from the fixed inner panel in a left and right arrangement;

an extendable and retractable assembly situated between the fixed inner panel and the movable outer panel, the extendable and retractable assembly comprising two rotational rods that are hinged together crosswise and capable of rotating relative to each other, thereby enabling the movable outer panel to transition between a folded position towards the fixed inner panel and an open position away from the fixed inner panel;

upper supports and lower supports that are spaced apart in an upper and lower arrangement and positioned on an inner wall of the fixed inner panel and an inner wall of the movable outer panel; the upper supports comprising longitudinal guide slots; guide pins slidably engage within the guide slots and being located at ends of the rotational rods; a first end of each rotational rod slidably engaging with the upper support, while a second end of each rotational rod is hinged on the lower support diagonally opposite to the respective upper support; a horizontal limiting groove being provided at an end of one of the guide slots on one of the upper supports;

an auxiliary spring being positioned between the fixed inner panel and the movable outer panel, deforming to generate elastic force when the movable outer panel is relatively distant from the fixed inner panel;

an armrest cover enveloping both the fixed inner panel and the movable outer panel, the armrest cover forming a flexible support portion for the armrest between the fixed inner panel and the movable outer panel;

wherein in an in-use state, the movable outer panel is in an open position, and the armrest's flexible support portion is correspondingly tensioned; the movable outer panel moves from a folded position relative to the fixed inner panel to the open position, causing the guide pins to slide to ends of the guide slots; the auxiliary spring stretches and deforms, providing a horizontal restoring force to the movable outer panel, causing the guide pins to move horizontally and engage with the limiting groove.

12. The extendable and retractable sofa armrest assembly according to claim 11, wherein, the guide slots are longitudinally inclined; and, from top to bottom, each guide slot extends diagonally towards a center direction of the rotational rods.

13. The extendable and retractable sofa armrest assembly according to claim 11, wherein, the auxiliary spring is inclinedly positioned between the fixed inner panel and the movable outer panel.

14. The extendable and retractable sofa armrest assembly according to claim 13, wherein, hook seats are respectively provided at an upper end of the fixed inner panel and a lower end of the movable outer panel; the hook seats are horizontally spaced apart from the upper supports and lower supports; two ends of the auxiliary spring are respectively connected to the hook seats.

15. The extendable and retractable sofa armrest assembly according to claim 11, wherein, the auxiliary spring is horizontally positioned between the fixed inner panel and the movable outer panel.

16. The extendable and retractable sofa armrest assembly according to claim 15, wherein, hook seats are respectively provided at an upper end of the fixed inner panel and a lower end of the movable outer panel; the hook seats are horizontally spaced apart from the upper supports and lower supports; two ends of the auxiliary spring are respectively connected to the hook seats.

* * * * *